US009025999B2

(12) United States Patent
Kitagawa

(10) Patent No.: US 9,025,999 B2
(45) Date of Patent: May 5, 2015

(54) FIXING APPARATUS

(71) Applicant: Canon Kabushiki Kaisha, Tokyo (JP)

(72) Inventor: Oki Kitagawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 35 days.

(21) Appl. No.: 13/866,588

(22) Filed: Apr. 19, 2013

(65) Prior Publication Data

US 2013/0287460 A1 Oct. 31, 2013

(30) Foreign Application Priority Data

Apr. 27, 2012 (JP) ..... 2012-103011

(51) Int. Cl.
*G03G 21/16* (2006.01)
*G03G 15/20* (2006.01)

(52) U.S. Cl.
CPC ..... *G03G 15/2075* (2013.01); *G03G 15/2025* (2013.01)

(58) Field of Classification Search
CPC ..... G03G 15/80; H02M 7/217
USPC ..... 399/88
See application file for complete search history.

(56) References Cited

U.S. PATENT DOCUMENTS 6,816,699 B1 * 11/2004 Katayanagi et al. ..... 399/333
8,208,833 B2 6/2012 Kitagawa
2008/0112736 A1 * 5/2008 Kimura ..... 399/328
2011/0135352 A1 * 6/2011 Takada ..... 399/327
2012/0027444 A1 2/2012 Kitagawa
2013/0051831 A1 2/2013 Shinagawa et al.
2013/0058672 A1 3/2013 Takada et al.
2013/0129364 A1 5/2013 Kitagawa et al.
2013/0142532 A1 6/2013 Kitagawa et al.
2013/0164015 A1 6/2013 Kawai et al.

FOREIGN PATENT DOCUMENTS

JP 2000-122453 A 4/2000
JP 2002-162857 A 6/2002

OTHER PUBLICATIONS

Machine translation of Kuribayashi JP 2002-162857 A, publication date: Jun. 7, 2002.*
English-language translation of JP 2002-162857 published Jun. 7, 2002.

* cited by examiner

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

A fixing apparatus includes: a rotatable fixing member and a rotatable pressing member which are configured to fix a toner image on a sheet at a nip therebetween, wherein the rotatable fixing member has a first toner parting layer formed of a fluorine-containing resin material, and the rotatable pressing member has a second toner parting layer formed of a fluorine-containing resin material in which an electroconductive filler is contained; and a contact member provided contactable to the second toner parting layer and being electrically grounded. The second toner parting layer has surface resistivity lower than that of the first toner parting layer and has a thickness smaller than that of the first toner parting layer.

13 Claims, 4 Drawing Sheets

FIXING APPARATUS

FIELD OF THE INVENTION AND RELATED ART

The present invention relates to a fixing apparatus (fixing device) for fixing a toner image on a sheet.

In an image forming apparatus of an electrophotographic type, the toner image is transferred onto a recording material (sheet) and then is fixed on the recording material by the fixing apparatus.

Such a fixing apparatus is described in Japanese Laid-Open Patent Application (JP-A) 2012-162857 and JP-A 2000-122453. Specifically, the fixing apparatus includes a fixing member (rotatable fixing member) in which a heat source is incorporated and a pressing member (rotatable pressing member) to be pressed against the fixing member, and a nip is formed by the fixing member and the pressing member. At this nip, the recording material on which the toner image is carried is heated and pressed, so that the toner image is fixed on the recording material.

Incidentally, with passing of the recording material through the nip, the fixing member and the pressing member are electrically charged by friction with the recording material in some cases. Then, when such triboelectric charging of the fixing member and the pressing member is not negligible, there is a possibility that a phenomenon which is called "electrostatic offset" is generated. That is, there is a possibility that depending on the direction and strength of an electric field generated by the triboelectric charge between the fixing member and the pressing member, a part of the toner image on the recording material remains on the fixing member or the toner on the recording material is repelled to disturb the toner image.

For that reason, in the fixing apparatus described in JP-A 2002-162857, the generation of the electrostatic offset phenomenon is intended to be prevented by discharging the surfaces of the fixing member and the pressing member with a discharging brush. Specifically, in the fixing apparatus described in JP-A 2002-162857, the fixing member is formed by a mental core and a toner parting layer (resin layer) which coats the metal core, and the pressing member is formed by a metal core, a rubber layer which coats the metal core, and a toner parting layer (resin layer), which coats the rubber layer. Further, the toner parting layers as surface layers of the fixing member and the pressing member are made semiconductive, and the discharging brush (discharging member) is contacted to the toner parting layer to effect discharging.

Further, in the fixing apparatus described in JP-A 2000-122453, the generation of the electrostatic offset phenomenon is intended to be prevented by forming a desired electrostatic field between the fixing member and the pressing member under the application of a voltage to the pressing member.

However, in JP-A 2002-162857 and JP-A 2000-122453, to the toner parting layers (surface layers) formed of a fluorine-containing resin material, an electroconductive filler, such as carbon black, is added for making the toner parting layers semiconductive and therefore a problem can arise.

Here, in the case where the filler is added,compared with the case where the filler is not added, it is known that the toner parting layer is hardened. Therefore, in such a case where the electroconductive filler is added to the toner parting layer of the pressing member in order to discharge the pressing member by the discharging member, but is not added to the toner parting layer of the fixing member, a problem can occur. Specifically, the fixing member and the pressing member are different in degree of deformation when the recording material passes through the nip, and the fixing member is deformed in a larger degree than the pressing member (FIG. 4(*a*)).

Thus, when the degree of the deformation of the toner parting layer of the fixing member is large, the degree of stress concentration is large at an edge portion of the recording material (with respect to a direction perpendicular to a recording material conveyance direction), so that abrasion (wearing) at the edge portion is accelerated, and thus there is a possibility that a shortening of the life of the fixing member is invited.

SUMMARY OF THE INVENTION

A principal object of the present invention is to provide a fixing apparatus capable of suppressing a shortening of the life of a rotatable fixing member while properly discharging the rotatable fixing member.

According to an aspect of the present invention, there is provided a fixing apparatus comprising: a rotatable fixing member and a rotatable pressing member which are configured to fix a toner image on a sheet at a nip therebetween, wherein the rotatable fixing member has a first toner parting layer formed of a fluorine-containing resin material, and the rotatable pressing member has a second toner parting layer formed of a fluorine-containing resin material in which an electroconductive filler is contained; and a contact member provided contactable to the second toner parting layer and being electrically grounded, wherein the second toner parting layer has surface resistivity lower than that of the first toner parting layer and has a thickness smaller than that of the first toner parting layer.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS (Embodiment 1)

[General Structure of Image Forming Apparatus]

Hereinbelow, embodiments of the present invention will be described specifically with reference to the drawings.

Figure 1:
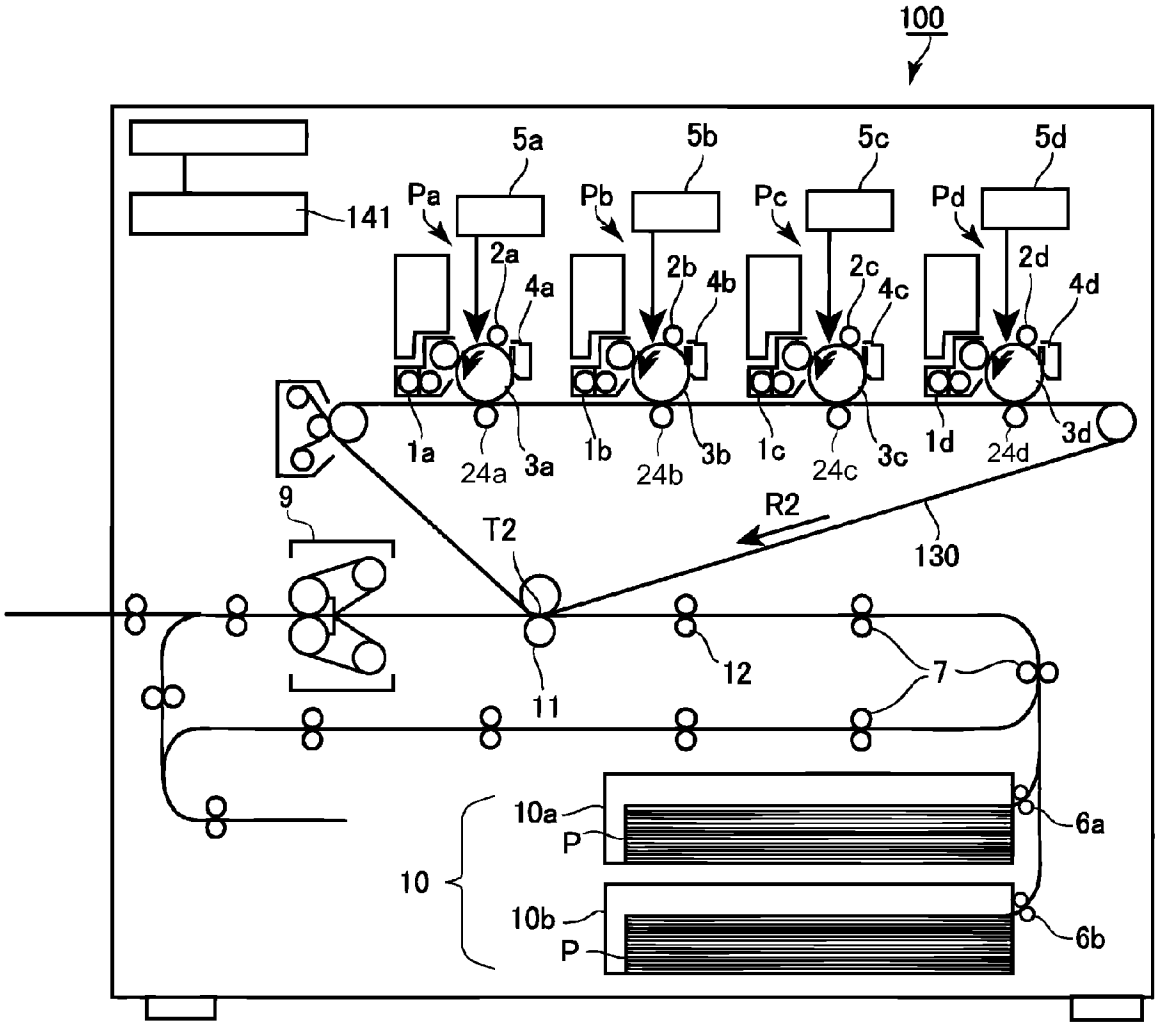
FIG. 1 is a schematic view showing an image forming apparatus.

As shown in FIG. 1, in an image forming apparatus 100, first to fourth image forming portions Pa, Pb, Pc and Pd are juxtaposed and toner images of different colors (yellow, magenta, cyan and black) are formed through a process including latent image formation, development and transfer. The image forming portions Pa, Pb, Pc and Pd include dedicated image bearing members, i.e., electrophotographic photosensitive drums 3*a*, 3*b*, 3*c* and 3*d*, respectively, in this embodiment, and on each of the drums 3*a*, 3*b*, 3*c* and 3*d*, an associated color toner image is formed. Adjacent to the respective drums 3*a*, 3*b*, 3*c* and 3*d*,an intermediary transfer member 130 is provided. The respective color toner images formed on the drums 3*a*, 3*b*, 3*c* and 3*d* are primary-transferred onto the intermediary transfer member 130 and then are transferred onto a recording material (sheet) P at a secondary transfer portion T2. Further, the recording material P on which the toner images are transferred is subjected to fixing of the toner images by a fixing apparatus (device) 9 as an image heating apparatus under heat and pressure, and thereafter is discharged to the outside of the image forming apparatus as a recording-image-formed product.

At the peripheries of the drums 3*a*, 3*b*, 3*c* and 3*d*, drum chargers 2*a*, 2*b*, 2*c* and 2*d*, developing devices 1*a*, 1*b*, 1*c* and 1*d*, primary transfer chargers 24*a*, 24*b*, 24*c* and 24*d* and cleaners 4*a*, 4*b*, 4*c* and 4*d* are respectively provided. Further, above the photosensitive drums 3*a*, 3*b*, 3*c* and 3*d*, light source devices 5*a*, 5*b*, 5*c* and 5*d* each including a polygon mirror are respectively provided.

Laser light emitted from each of the light source devices 5*a*, 5*b*, 5*c* and 5*d* is subjected to scanning by rotation of the polygon mirror, and fluxes of the scanning light are deflected by a reflection mirror. Then, the light fluxes are focused on generating lines of the photosensitive drums 3*a* to 3*d* by fθ lenses to expose the photosensitive drums 3*a* to 3*d* to light, so that latent images depending on image signals are formed on the photosensitive drums 3*a* to 3*d*.

In the developing devices 1*a*, 1*b*, 1*c* and 1*d*, as developers, toners of yellow, magenta, cyan and black, respectively, are filled in a predetermined amount by unshown supplying devices. The developing devices 1*a*, 1*b*, 1*c* and 1*d* develop the latent images on the photosensitive drums 3*a*, 3*b*, 3*c* and 3*d*, respectively, to visualize the latent images as a yellow toner image, a magenta toner image, a cyan toner image and a black toner image, respectively.

The intermediary transfer member 130 is rotationally driven in a direction indicated by an arrow R2 in FIG. 1 at substantially the same peripheral speed as those of the photosensitive drums 3*a*, 3*b*, 3*c* and 3*d*. The yellow toner image for a first color formed and carried on the photosensitive drum 3*a* is intermediary-transferred onto an outer peripheral surface of the intermediary transfer member 130 by pressure and an electric field formed by a primary transfer bias applied to the intermediary transfer member 130 when the yellow toner image passes through a nip between the photosensitive drum 3*a* and the intermediary transfer member 130.

Thereafter, similarly, the magenta toner image for a second color, the cyan toner image for a third color and the black toner image for a fourth color are successively transferred to be superposed onto the intermediary transfer member 130, so that a synthetic color toner image corresponding to an objective color image is formed.

A secondary transfer roller 11 is shaft-supported in parallel correspondingly to the intermediary transfer member 130 and is disposed in contact with a lower surface portion of the intermediary transfer member 130. To the secondary transfer roller 11, a desired secondary transfer bias is applied by a secondary transfer bias voltage source.

The recording material (sheet) P is fed from sheet feeding cassettes 10*a* and 10*b* and passed through sheet feeding portions 6*a* and 6*b*, a registration roller pair 12 and a front transfer guide to be conveyed into a contact nip (secondary transfer portion) between the intermediary transfer member 130 and the secondary transfer roller 11 at a predetermined timing. The synthetic color toner image superposedly transferred on the intermediary transfer member 130 is transferred from the intermediary transfer member 130 onto the recording material P by applying a secondary transfer bias from a bias voltage source to the secondary transfer roller 11 concurrently with the feeding of the recording material P into the contact nip T2.

Incidentally, the secondary transfer bias applied toward the recording material P during the toner image transfer is opposite in polarity to the electric charges of the toner and is controlled by a controller 141 so as to be optimally set depending on the environment (ambient temperature and humidity of the apparatus) and the type (basis weight and surface property) of the recording material P. Further, the controller 141 effects secondary transfer-roller cleaning control in which the second transfer bias of the same polarity as the toner charge polarity is applied for a predetermined time to the secondary transfer roller 11 at a sheet interval during continuous sheet passing and after the end of a job. As a result, scattering toner deposited on the secondary transfer roller 11 and fog toner are returned toward the intermediary transfer member 130 side, so that a deterioration of transfer performance and back-surface contamination of the recording material P can be prevented.

[Fixing Apparatus]

The fixing apparatus (image heating apparatus) 9 for heating and pressing the recording material P on which the toner image is formed at each of the image forming portions Pa, Pb, Pc and Pd described above will be specifically described.

Figure 2:
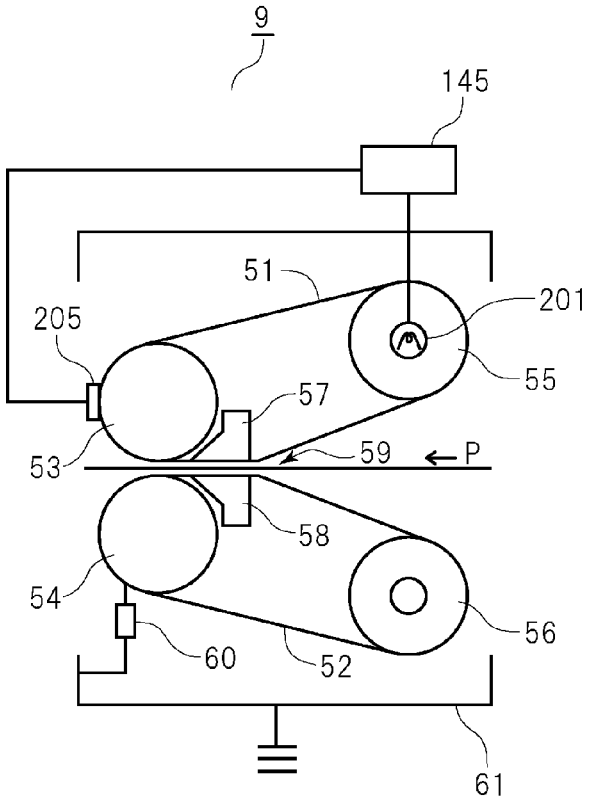
FIG. 2 is a schematic view showing a fixing apparatus.

As shown in FIG. 2, the fixing apparatus 9 includes a fixing belt (rotatable fixing member) 51, a fixing roller 53 and a fixing tension roller 55, and the fixing belt 51 is stretched by the fixing roller 53 and the fixing tension roller 55 in a predetermined tension-applied state. The fixing roller 53 is constituted so as to be rotationally drivable by an unshown driving source, and the fixing belt 51 is rotationally driven by driving the fixing roller 53.

Further, the fixing tension roller 55 is a roller formed with a metal-made pipe, and inside the roller 55, a halogen heater (heating device) 201 for heating the fixing belt 51 is provided. That is, the fixing belt 51 is heated by the halogen heater 201 as the heating device to generate heat. Further, the surface temperature of the fixing belt 51 is measured by a thermometer 205, and on the basis of a measured value of the thermometer 205, the halogen heater 201 is controlled by a temperature control device 145 so as to have a predetermined surface temperature.

Further, the fixing apparatus 9 includes a pressing belt (rotatable pressing member) 52, a pressing roller 54 and a pressing tension roller 56, and the pressing belt 52 is stretched by the pressing roller 54 and the pressing tension roller 56 in a predetermined tension-applied state. The pressing roller 54 is constituted so as to be rotationally drivable vertically, so that the pressing belt 52 can be moved toward and away from the fixing belt 51.

In the fixing apparatus 9, the pressing belt 52 is pressed against the fixing belt 51 at predetermined nip pressure, so that a nip 59 is formed where the recording material P is to be heated and pressed. The nip 59 is widely formed with respect to a conveyance direction of the recording material P by providing pressing pads 57 and 58, in the tension roller sides of the fixing roller 53 and the pressing roller 54, for pressing (urging) the fixing belt 51 and the pressing belt 52 toward outer peripheral surfaces of the belts 51 and 52 in contact with inner peripheral surfaces of the belts 51 and 52.

Further, when the fixing belt 51 is rotated, the pressing belt 52 is rotated via the nip 59 by the rotation of the fixing belt 51, so that the nip, for fixing the toner image is where the recording material P is to be nipped and conveyed. The recording material P is heated and pressed at the nip 59, which is wide with respect to the conveyance direction, to have a temperature not less than the melting point of the toner, so that the toner image, which is electrostatically carried, is fixed on the recording material P. Incidentally, the fixing apparatus 9 is usable as not only an apparatus for fixing the toner image by heating and pressing the recording material P on which the unfixed toner image is formed as in this embodiment, but also as an apparatus for glossing an image by heating and pressing the recording material on which the toner image has already been fixed.

[Contact Member]

A constitution of a discharging brush 60 as a contact member for adjusting a charging state of the surface of the pressing belt 52 will be described with reference to FIG. 2. As described above, with passing of many recording materials P through the nip 59, the fixing belt 51 and the pressing belt 52, which form the nip, tend to be triboelectrically charged by the friction with the recording materials P.

For example, when the fixing belt 51 and the pressing belt 52 are triboelectrically charged to a non-negligible degree, by the electrostatic field generated in the neighborhood of the nip, the toner is attracted to the fixing belt 51 to be electrostatically offset, so that there is a possibility that a lowering in image quality is invited. Further, when the direction of the electrostatic field is such that the electrostatic field is directed from the fixing belt 51 toward the pressing belt 52, depending on the magnitude of the electrostatic field, there is a possibility that the toner is repelled to disturb the toner image electrostatically held on the recording material P. That is, there is a possibility that the image quality is lowered.

For that reason, in this embodiment, as shown in FIG. 2, the fixing apparatus 9 includes the discharging brush 60 for discharging the pressing belt 52 and being in contact with the surface (toner parting layer 523) of the pressing belt 52. Specifically, the discharging brush 60 is mounted on a frame 61, of the fixing apparatus 9 (the image forming apparatus 1), which is electrically grounded.

[Layer Structure of Fixing Belt and Pressing Belt]

Figure 3:
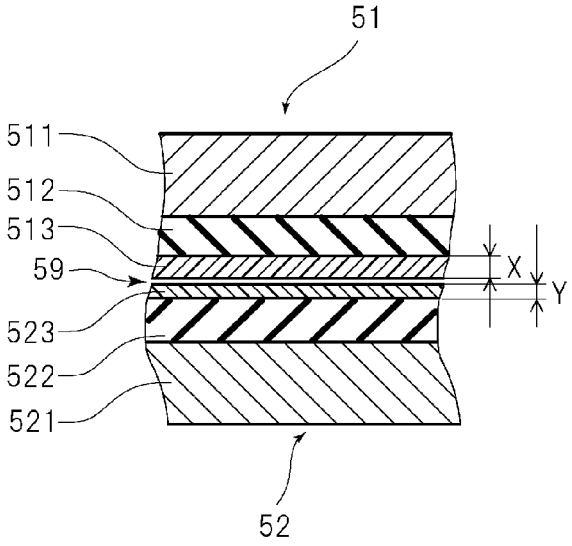
FIG. 3 is a schematic view showing structures of a fixing belt and a pressing belt of the fixing apparatus shown in FIG. 2.

A layer structure of each of the fixing belt 51 and the pressing belt 52 will be specifically described. FIG. 3 is a side view in which the fixing belt 51 and the pressing belt 52 are cut in parallel to the conveyance direction of the recording material P. As shown in FIG. 3, the fixing belt 51 is a belt having a three-layer structure including, from its inner peripheral surface side to its outer peripheral surface side, a base layer 511, an elastic layer 512 and a surface layer (toner parting layer) 513. The base layer 511 is constituted by a polyimide sleeve or a metal sleeve.

The elastic layer 512 is formed of an elastic material, such as silicone rubber and more specifically, silicone sponge rubber, and is constituted to coat the base layer 511. Further, the surface layer 513 contactable to the recording material P is formed of a fluorine-containing resin material having an excellent heat resistant property and toner parting property. As the fluorine-containing resin material, it is possible to use a perfluoroalkoxy tetrafluoroethylene copolymer (PFA), a polytetrafluoroethylene copolymer (PTFE), and the like.

Further, similarly, the pressing belt 52 is a belt having a three-layer structure including, from its inner peripheral surface side to its outer peripheral surface side, a base layer 521, an elastic layer 522 and a surface layer (toner parting layer) 523. The base layer 521 is constituted by a polyimide sleeve or a metal sleeve.

The elastic layer 522 is formed of an elastic material, such as silicone rubber and more specifically, silicone sponge rubber, and is constituted to coat the base layer 521. Further, the surface layer 523, of the pressing belt 52, to be pressed against the surface layer 513 of the fixing belt 51 to form the nip 59 is formed of a fluorine-containing resin material having an excellent heat resistant property and toner parting property. As the fluorine-containing resin material, it is possible to use the perfluoroalkoxy tetrafluoroethylene copolymer (PFA), the polytetrafluoroethylene copolymer (PTFE), and the like.

Incidentally, the fluorine-containing resin material for forming the surface layers 513 and 523 of the fixing belt 51 and the pressing belt 52 is an insulative resin material, but is made semiconductive in order to discharge at least the surface layer 523 of the pressing belt 52 with the discharging brush 60. For that purpose, the surface layer 523 of the pressing belt 52 is formed of the fluorine-containing resin material in which an electroconductive filler is added. Incidentally, in the surface layer 513 of the fixing belt 51, the electroconductive filler is not added or is added in a slight amount, so that the surface layer 513 of the fixing belt 51 is formed of the fluorine-containing resin material which is insulative or substantially insulative. That is, a constitution in which the surface resistivity of the surface layer 523 of the pressing belt is sufficiently lower than the surface resistivity of the surface layer 513 of the fixing belt 51 is employed. Incidentally, as the electroconductive filler, it is possible to use carbon black powder, nickel powder, nickel-coated material, mixtures of carbon black powder with nickel power or nickel-coated material, and the like. In this embodiment, as the electroconductive filler, carbon black powder is used.

On the other hand, it is also known that when the electroconductive filler is added, the fluorine-containing resin material, such as PFA or PTFE, for forming the surface layers 513 and 523 of the fixing belt 51 and the pressing belt 52, lowers physical values of certain parameters of belts, such as their tensile strength, their tensile modulus or their elongation. That is, it is known that the fluorine-containing resin material is hardened depending on the proportion of addition of an electroconductive substance.

For that reason, in this embodiment, the layer thickness Y of the surface layer 523 of the pressing belt 52 is made smaller than the layer thickness X of the surface layer 513 of the fixing belt 51. That is, when the belt layer thicknesses X and Y are made thin, the elasticity of the elastic layers 512 and 522 have an influence on the surface layers 513 and 523, so that the surface layers 513 and 523 are liable to be deformed. Therefore, the surface layer 523, of the pressing belt 52, which is low in surface resistivity and which is relatively hard, is formed in a small thickness, and the surface layer 513, of the fixing belt 51, which is high in surface resistivity and which is relatively soft, is formed in a large thickness.

Figure 4:
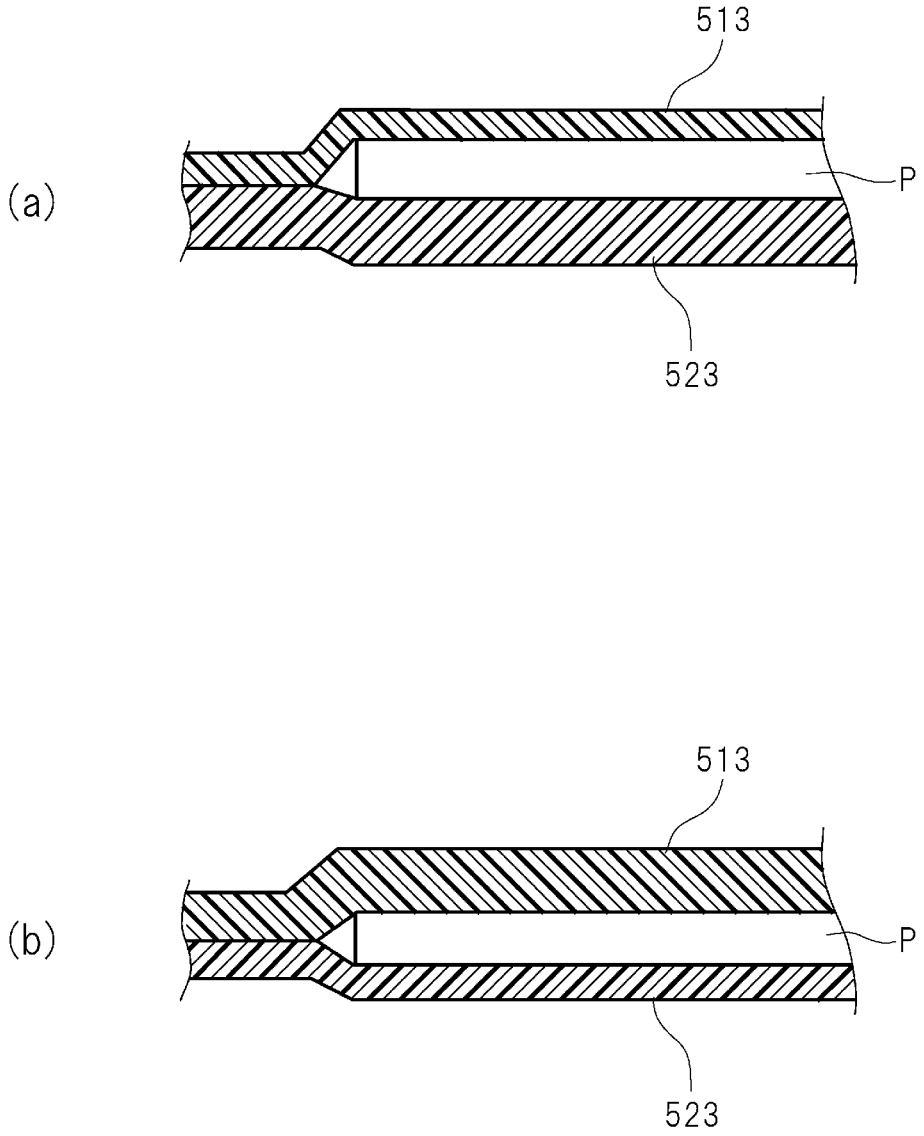
FIGS. 4(*a*) and 4(*b*) are schematic views each for illustrating a deformation amount of each of the fixing belt and the pressing belt when a recording material passes through a nip, wherein FIG. 4(*a*) shows the case where a deformation balance between the fixing belt and the pressing belt is not achieved, and FIG. 4(*b*) shows the case where the deformation balance between the fixing belt and the pressing belt is achieved.

As a result, when the recording material P passes through the nip 59, the fixing belt 51 and the pressing belt 52 are deformed in a balanced state as shown in FIG. 4(*b*) without losing the deformation balance therebetween, as shown in FIG. 4(*a*) (out of balance). For that reason, the degree of stress concentration generated at the surface layer when the fixing belt 51 and the pressing belt 52 are contacted to edge portions of the recording material P can be reduced, so that a force exerted on the fixing belt side and the pressing belt side is dispersed (distributed) to realize a reduction in the degree of abrasion (wearing) and an improvement in durability of both the belts 51 and 52.

A durability test, using the fixing apparatus 9 mounted in the image forming apparatus 1 capable of outputting A4-sized sheets at an output rate of 80 sheets per minute and at a process speed of 320 mm/sec, will be described. First, for comparison of the electrostatic offset performance, the cases where the surface layers 513 and 523 of the fixing belt 51 and the pressing belt 52 are changed in surface resistivity are compared.

The constitution of the fixing apparatus 9 and the test conditions are as follows.

[Constitution of Fixing Apparatus]

Fixing belt: inner diameter=50 mm, thickness=70 μm, base layer (Ni-made endless belt), elastic layer (500 μm-thick silicone rubber layer), surface layer (40 μm-thick PFA tube)

Fixing roller: outer diameter=20 mm

Fixing tension roller: outer diameter=20 mm

Pressing belt: inner diameter=50 mm, thickness=70 μm, base layer (Ni-made endless belt), elastic layer (400 μm-thick silicone rubber layer), surface layer (30 μm-thick PFA tube)

Pressing roller: outer diameter=20 mm

Pressing tension roller: outer diameter=20 mm

Heating device: 1000 W halogen heater

Nip width: 15 mm (total load during press-contact at nip=about 80 kgf)

Recording material used: Thick paper having high volume resistivity (basis weight=200 gsm)

Print condition: continuous printing of 1000 sheets of half-tone image

Next, test conditions and the presence or absence of generation of the electrostatic offset in each of Experimental example ("EE") 1 in which relationships in this embodiment are satisfied and Comparison examples ("CE") 1 and 2 are shown in Table 1.

TABLE 1

| | FBSR*1 | PBSR*2 | FBSP*3 | PBSP*4 | EO*5 |
|---|---|---|---|---|---|
| EE 1 | $1.0\times10^{13\text{-}15}$ | $1.0\times10^{7\text{-}9}$ | 0 to −100 | 0 | ○ |
| CE 1 | $1.0\times10^{13\text{-}15}$ | $1.0\times10^{13\text{-}15}$ | −200 to −500 | −500 to −900 | x |
| CE 2 | $1.0\times10^{7\text{-}9}$ | $1.0\times10^{13\text{-}15}$ | 0 to −100 | −500 to −900 | x |

*1: "FBSR" is the fixing belt surface resistivity (Ω/sq).
*2: "PBSR" is the pressing belt surface resistivity (Ω/sq).
*3: "FBSP" is the fixing belt surface potential (V).
*4: "PBSP" is the pressing belt surface potential (V).
*5: "EO" is the electrostatic offset.
"○" represents that the electrostatic offset is not generated.
"x" represents that the electrostatic offset is generated.

In Experimental example 1, the surface resistivity B of the surface layer of the fixing belt 51 is in a range of: $1.0\times10^{13}$ (Ω/sq)≤B≤$10^{15}$(Ω/sq). Further, the surface resistivity C of the surface layer 523 of the pressing belt 52 is in a range of: $1.0\times10^{7}$ (Ω/sq)≤C≤$1.0\times10^{9}$ (Ω/sq).

From a result of Table 1, it is understood that with respect to the fixing belt 51 and the pressing belt 52 in Experimental example 1, compared with Comparison examples 1 and 2, a difference in surface potential between the surface layers 513 and 523 are not readily caused. This is because the surface layer 523 of the pressing belt 52 is made semiconductive by adding the carbon black filler therein and is discharged by the discharging brush 60. That is, the surface layer 523 of the pressing belt 52 is electrically charge-removed by the discharging brush 60. Further, also with respect to the surface layer 513 of the fixing belt 51, the surface potential is made close to zero by discharging the surface layer 513 in contact with the surface layer 523 of the pressing belt 52 or by the discharging of the surface layer 523 of the pressing belt 52.

Accordingly, it was confirmed that when the surface resistivities of the surface layers 513 and 523 of the fixing belt 51 and the pressing belt 52 were set in the range in Experimental example 1, the unfixed toner image (negative polarity) immediately entering the nip 59 was not readily disturbed and thus the electrostatic offset phenomenon was not readily generated.

Next, Table 2 shows a result of evaluation of gloss streaks of an image when a durability test is performed in which the layer thickness of each of the surface layers 513 and 523 of the fixing belt 51 and the pressing belt 52 is specified in Table 2, and Table 2 also shows the results of the evaluation of in-plane image glossiness non-uniformity with respect to a solid black. The fixing apparatus 9 has the same constitution as that of the fixing apparatus subjected to the comparison of the above-described electrostatic offset performance except that the layer thickness and microhardness of each of the surface layers 513 and 523 of the fixing belt 51 and the pressing belt 52 are changed as shown in Table 2, and the surface resistivity of each of the surface layers 513 and 523 are changed as shown below. Test conditions are shown below.

[Constitution of Fixing Apparatus]

Resistivity of fixing belt surface layer: $1.0\times10^{13}$(Ω/sq)

Resistivity of pressing belt surface layer: $1.0\times10^{7}$(Ω/sq)

[Test Condition 1 (Gloss Streaks Evaluation)]

The evaluation is made based on whether or not streaks of a black half-tone image at the edge portions of the recording material P (one-side coated paper of 128 gsm in basis weight and 13 inch×19 inch in size) printed immediately after printing o $100\times10^{3}$ sheets of thick paper (basis weight: 160 gsm, A3 size) are visually observed.

[Test Condition 2 (In-Plane Image Glossiness Non-Uniformity)]

TABLE 2

| | X*1 | Y*2 | X/Y*3 | V*4 | W*5 | GS*6 | GN*7 |
|---|---|---|---|---|---|---|---|
| EE 2 | 40 | 30 | 1.33 | 85.5 | 80.2 | ○ | ○ |
| EE 3 | 45 | 30 | 1.5 | 85.5 | 87.3 | ○ | ○ |
| EE 4 | 50 | 30 | 1.67 | 88.1 | 80.2 | ○ | x |
| CE 3 | 40 | 40 | 1 | 74.4 | 80.2 | Δ | ○ |
| CE 4 | 20 | 30 | 0.67 | 90.4 | 80.2 | x | ○ |

*1"X" is the fixing belt surface layer thickness (μm).
*2"Y" is the pressing belt surface layer thickness (μm).
*3"XY" is the surface layer thickness ratio.
*4"V" is the fixing belt surface layer microhardness (degrees).
*5"W" is the pressing belt surface layer microhardness (degrees).
*6"GS" is the gloss streaks.
"○" denotes that the gloss streaks are not generated.
"Δ" denotes that the gloss streaks start to be generated.
"x" denotes that the gloss streaks are generated.
*7"GN" is the glossiness non-uniformity.
"○" denotes that the glossiness non-uniformity is not generated.
"x" denotes that the glossiness non-uniformity is generated.

The abrasion of the surface layers 513 and 523 of the fixing belt 51 and the pressing belt 52 is generated by continuous contact of the left and right edge portions of the recording material P, parallel to the recording material conveyance direction, with the fixing belt 51 and the pressing belt 52 during continuous sheet passing. Particularly, the abrasion is liable to occur in the case where the layer thickness is high as in the thick paper used as the recording material P. When the abrasion is generated at the surface layer of the fixing belt 51, the abrasion is liable to lead to a lowering in image quality.

As shown in Table 2, in Experimental examples ("EE") 2 to 4, it is understood that the gloss streaks due to surface abrasion of the fixing belt 51 are not generated. On the other hand, when the layer thickness of the surface layer 513 of the fixing belt 51 is X (μm), the layer thickness of the surface layer 523 of the pressing belt 52 is Y (μm) and a layer thickness ratio X/Y of the layer thickness X of the surface layer 513 of the fixing belt 51 to the layer thickness Y of the surface layer 523 of the pressing belt 52 is A, in Comparison example ("CE") 3 in which the layer thickness ratio A is 1, the gloss streaks started to be generated.

This can be explained because when the layer thickness X of the surface layer 513 of the fixing belt 51 is excessively thin, the fixing belt 51 having the elastic layer 52 under the thin surface layer 513 has a small microhardness as a whole, and thus the amount of deformation is increased when the recording material P is conveyed, thus accelerating the abrasion. Accordingly, it can be said that the range of the layer thickness ratio at which the gloss streaks are not generated is $1<A\leq1.67$ from the result of Table 2.

Further, glossiness non-uniformity, which affects the image quality, can be due to the hardness of the surface layer 513 of the fixing belt 51. The glossiness non-uniformity is a phenomenon that occurs when the surface of the fixing belt 51 does not flexibly follow projections and recesses of the recording material P or the unfixed toner image on the recording material P, so as to generate non-uniformity in the degree of application of heat and pressure, which makes visible the paper fiber non-uniformity as the glossiness non-uniformity.

Referring to the result in Table 2, in Experiment example ("EE") 4, the glossiness non-uniformity was generated. This would be explained because even when the surface layer (fluorine-containing resin material layer) of the fixing belt 51 is thick, and thus the microhardness of the fixing belt 51 is excessively high as a whole, the fixing belt surface does not flexibly follow the image surface, and therefore melting non-uniformity of the unfixed toner. image is caused to occur. From this result, it can be said that the layer thickness ratio range in which the glossiness non-uniformity is not generated is $0.67\leq A\leq1.5$.

From the above results, it is understood that the layer thickness ratio A between the surface layer 513 of the fixing belt 51 and the surface layer 523 of the pressing belt 52 may suitably be $1<A\leq1.67$ from the viewpoint of the durability of the belt, and may optimally be $1<A\leq1.5$, also by taking the image quality into consideration. Incidentally, in this embodiment, also, the elastic layers 512 and 522 are formed so that the elastic layer 512 of the fixing belt 51 is thicker than the elastic layer 522 of the pressing belt 52.

Further, with respect to sensitivity of the surface layer thickness of each of the fixing belt 51 and the pressing belt 52, in the case where the elastic layer is provided as an intermediate layer, it is possible to consider that the sensitivity is replaced with the microhardness of the belt as a whole. As shown in Table 2, a difference D(V−W) between the microhardness V(degrees) of the surface layer 513 of the fixing belt 51 and the microhardness W(degrees) of the surface layer 523 of the pressing belt 52 may suitably be in the range of: $-1.8$ (degrees)$\leq D\leq7.9$ (degrees) from the viewpoint of the belt durability. Further, when also the image quality is taken into consideration, the difference D in microhardness of the surface layer 523 of the pressing belt 52 from the surface layer 513 of the fixing belt 51 may suitably be in the range of: $-1.8$ (degrees)$\leq D\leq5.3$ (degrees).

Incidentally, measurement of the surface microhardness was performed in a state in which each of the fixing belt 51 and the pressing belt 52 were placed in a core formed of SUS, and a microhardness meter ("MD-1 type C", mfd. by Kobunshi Keiki Co., Ltd.) was used. Further, in the case where the elastic layer is sufficiently thicker than the surface layer (by, e.g., 300 μm or more), it is desirable that the microhardness of the surface layer is used as an index.

(Embodiment 2)

Figure 5:
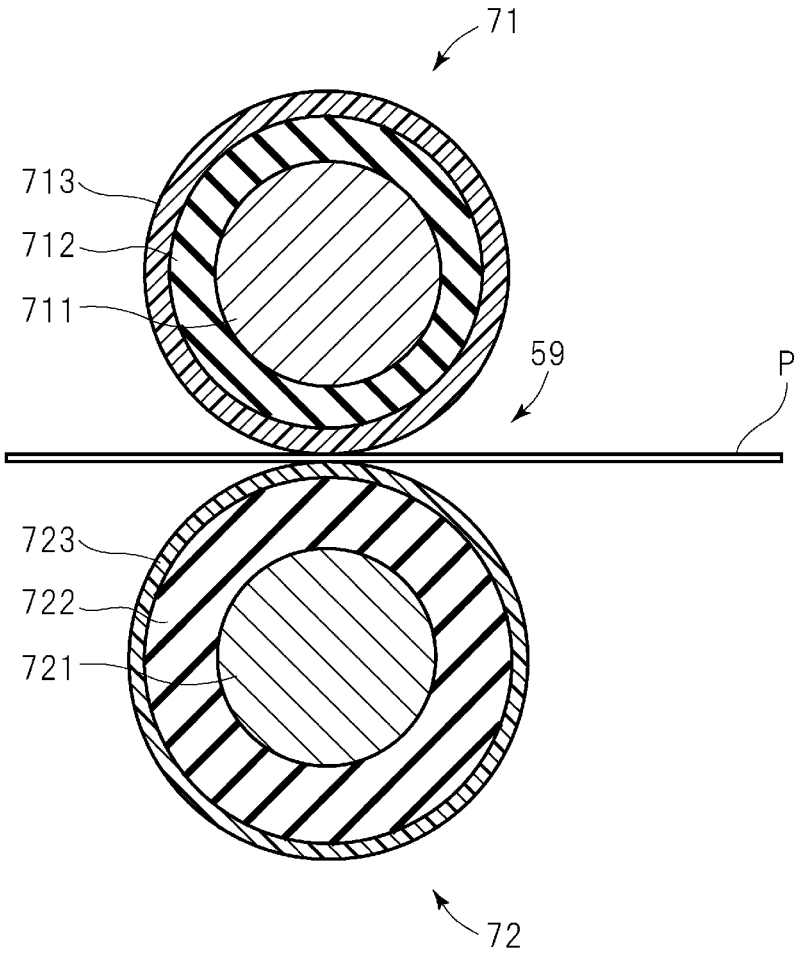
FIG. 5 is a schematic view showing a fixing apparatus.

In Embodiment 1 described above, the constitution in which the fixing apparatus 9 is of the belt-fixing type is employed, but a constitution in which the fixing apparatus 9 is of a heat-roller type may also be employed. Specifically, as shown in FIG. 5, the fixing apparatus 9 of the heat-roller type includes a fixing roller (rotatable fixing member) 71 including a base layer 711, an elastic layer 712 and a surface layer 713 and includes a pressing roller(rotatable pressing member) 72 including a base layer 721, an elastic layer 722 and a surface layer 723. Further, a constitution in which the nip 59 is formed by these fixing roller 71 and the pressing roller 72 is employed. Also in this case, the material the surface resistivity, the layer thickness ratio and the microhardness f each of the base layers 711 and 712, the elastic layers 712 and 722 and the surface layers 713 and 723 are the same as those in Embodiment 1.

Incidentally, in Embodiments 1 and 2, only the pressing belt 52 and the pressing roller 72 are discharged, but also the fixing belt 51 and the fixing roller 71 may be discharged by providing the discharging brush in the fixing belt 51 side and the fixing roller 72 side. Further, the discharging member is not necessarily required to be the brush, but the discharging may also be effected by, e.g., a cleaning roller.

Further, as the contact member for adjusting the charging state of each of the pressing belt 52 and the pressing roller 72, the contact member is not necessarily be required to be the discharging member. For example, the contact member may also be a device for positively controlling the electrostatic field so that the electrostatic offset phenomenon is prevented from generating by applying a bias voltage to the pressing belt 52 and the pressing roller 72.

Further, the fixing belt 51, the fixing roller 71, the belt 52 and the pressing roller 72 are not necessarily be required to have the three-layer structure, but may only be required that the surface layer contactable to the recording material P is laminated on the elastic layer. For example, the fixing and pressing belts 51 and 52 and the fixing and press rollers 71 and 72 may have a plurality of elastic layers or may have the base layer constituted as the elastic layer. Further, as the base layer, another metal such as stainless steel, other than nickel, may also be used. Further, in order to more effectively prevent the edge abrasion of the fixing belt 51 and the fixing roller 71, the fixing belt 51 and the fixing roller 71 may also be formed in longer circumferential length than the pressing belt 52 and the pressing roller 72.

Further, the heating apparatus for heating the fixing belt or the pressing belt can also be replaced with an induction heating apparatus, not the above-described halogen heater. Incidentally, the induction heating apparatus has a constitution including an exciting coil for generating magnetic flux. The constitution is such that an eddy current is generated in an object to be heated, so that Joule heat is generated by skin resistance of the objected to be heated itself.

Further, within the scope of the concept of the present invention, the constitutions of the various devices in the above-described embodiments can be replaced with other known constitutions.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 103011/2012 filed Apr. 27, 2012, which is hereby incorporated by reference.

What is claimed is:

1. A fixing apparatus comprising:

a rotatable fixing member and a rotatable pressing member which are configured to fix a toner image on a sheet at a nip therebetween, wherein said rotatable fixing member has a first toner parting layer formed of a fluorine containing resin material, and said rotatable pressing member has a second toner parting layer formed of a fluorine containing resin material in which an electroconductive filler is contained; and a contact member provided contactable to the second toner parting layer and being electrically grounded, wherein the second toner parting layer has surface resistivity lower than that of the first toner parting layer and has a thickness smaller than that of the first toner parting layer.

2. An apparatus according to claim 1, wherein when the thickness of the first toner parting layer is X (μm) and the thickness of the second toner parting layer is Y (μm), the following relationship is satisfied:

$$1.00<X/Y\leq 1.67.$$

3. An apparatus according to claim 1, wherein when the thickness of the first toner parting layer is X (μm) and the thickness of the second toner parting layer is Y (μm), the following relationship is satisfied:

$$1.00<X/Y\leq 1.5.$$

4. An apparatus according to claim 1, wherein when the surface resistivity of the first toner parting layer is B (Ω/sq) and the surface resistivity of the second toner parting layer is C (Ω/sq), the following relationships are satisfied:

$$1.0\times 10^{13}\leq B\leq 1.0\times 10^{15}, \text{ and}$$

$$1.0\times 10^{7}\leq C\leq 1.0\times 10^{9}.$$

5. An apparatus according to claim 1, wherein when the microhardness of the first toner parting layer is V (degrees) and the microhardness of the second toner parting layer is W (degrees), the following relationship is satisfied:

$$-1.8\leq V-W\leq 7.9.$$

6. An apparatus according to claim 1, wherein when the microhardness of the first toner parting layer is V (degrees) and the microhardness of the second toner parting layer is W (degrees), the following relationship is satisfied:

$$-1.8\leq V-W\leq 5.3.$$

7. An apparatus according to claim 1, wherein said contact member includes a brush which is electrically grounded and which is contacted to the second toner parting layer.

8. A fixing apparatus comprising:

a fixing belt and a pressing belt which are configured to fix a toner image on a sheet at a nip therebetween, wherein said fixing belt has a first base layer, a first elastic layer provided on the first base layer, and a first toner parting layer provided on the first elastic layer and wherein said pressing belt has a second base layer, a second elastic layer provided on the second base layer, and a second toner parting layer provided on the second elastic layer; and a contact member provided contactable to the second toner parting layer and being electrically grounded, wherein when the surface resistivity of the first toner parting layer is B (Ω/sq), the surface resistivity of the second toner parting layer is C (Ω/sq), the thickness of the first toner parting layer is X (μm), and the thickness of the second toner parting layer is Y (μm), the following relationships are satisfied:

$$1.0\times 10^{13}\leq B\leq 1.0\times 10^{15},$$

$$1.0\times 10^{7}\leq C\leq 1.0\times 10^{9}, \text{ and}$$

$$1.00<X/Y\leq 1.67.$$

9. An apparatus according to claim 8, wherein when the thickness of the first toner parting layer is X (μm) and the thickness of the second toner parting layer is Y (μm), the following relationship is satisfied:

$$1.00<X/Y\leq 1.5.$$

10. An apparatus according to claim 8, wherein when the microhardness of the first toner parting layer is V (degrees) and the microhardness of the second toner parting layer is W (degrees), the following relationship is satisfied:

$$-1.8\leq V-W\leq 7.9.$$

11. An apparatus according to claim 8, wherein when the microhardness of the first toner parting layer is V (degrees) and the microhardness of the second toner parting layer is W (degrees), the following relationship is satisfied:

$$1.8\leq V-W\leq 5.3.$$

12. An apparatus according to claim 8, wherein the first toner parting layer is formed of a fluorine containing resin material and the second toner parting layer is formed of a fluorine containing resin material in which an electroconductive filler is contained.

13. An apparatus according to claim 8, wherein said contact member includes a brush which is electrically grounded and which is contacted to the second toner parting layer.

* * * * *